US005355929A

United States Patent [19]

Sorensen

[11] Patent Number: 5,355,929

[45] Date of Patent: Oct. 18, 1994

[54] METHOD OF AND APPARATUS FOR MAKING CASTING MOULDS

[75] Inventor: Erik N. Sorensen, Ballerup, Denmark

[73] Assignee: Dansk Industri Syndikat A/S, Herlev, Denmark

[21] Appl. No.: 67,122

[22] Filed: May 26, 1993

[30] Foreign Application Priority Data

Jun. 10, 1992 [DK] Denmark ..... 0764/92

[51] Int. Cl.[5] ..... B22C 15/24; B22C 15/28

[52] U.S. Cl. ..... 164/20; 164/38; 164/195; 164/201

[58] Field of Search ..... 164/20, 21, 22, 38, 164/195, 200, 201, 202

[56] References Cited

U.S. PATENT DOCUMENTS

| | | | |
|---|---|---|---|
| 2,757,424 | 8/1956 | Daniel et al. | 164/195 |
| 2,899,724 | 8/1959 | Peterson | 164/202 |
| 2,911,691 | 11/1959 | Peterson | 164/202 |
| 4,313,486 | 2/1982 | Kondo et al. | 164/38 |
| 4,390,056 | 6/1983 | Grove et al. | 164/38 X |
| 5,038,845 | 8/1991 | Kluge | 164/200 X |
| 5,148,851 | 9/1992 | Murata | 164/38 X |
| 5,161,603 | 11/1992 | Volkomich et al. | 164/38 X |

FOREIGN PATENT DOCUMENTS

| | | | |
|---|---|---|---|
| 53516 | 8/1937 | Denmark . | |
| 146023 | 5/1983 | Denmark . | |
| 56-141940 | 11/1981 | Japan | 164/200 |
| 1468645 | 3/1989 | U.S.S.R. | 164/200 |

*Primary Examiner*—J. Reed Batten, Jr.
*Attorney, Agent, or Firm*—Larsen and Taylor

[57] ABSTRACT

A mould chamber including at least one pressing plate is filled by blowing mould sand in through a blowing-in tube ascending at high speed, in which at least some of the blowing-in apertures are adapted to blow the sand in substantially transversely to the ascending movement of the blowing-in tube.

7 Claims, 4 Drawing Sheets

METHOD OF AND APPARATUS FOR MAKING CASTING MOULDS

TECHNICAL FIELD

The present invention relates to a method of making casting moulds or casting-mould parts using a blowing-in duct member.

BACKGROUND ART

DK Patent Publication No. 53516 or DK Published Application No. 146.023 discloses a method including blowing mould sand into a mould chamber using a tube, prior to the blowing-in operation having been introduced far into the mould chamber and during the blowing-in operation being pulled or pushed back gradually, so that the blowing-in occurs locally in the places where the mouth of the tube passes by.

In the process disclosed in this manner, the blowing-in operation is substantially directed more or less in a direction directly opposite to the direction in which the tube is being moved out of the mould chamber during the blowing-in operation. Admittedly, said publication mentions a single exception, viz. on page 5, first column, 3rd paragraph, referring to the possibility of imparting a helical movement to the sand when it leaves the mouthpiece. Even with such a helical movement, the sand will, however, substantially be blown in in a backward direction relative to the outwardly directed working movement of the blowing-in tube. For which reason the method is not well suited to the making of casting moulds or casting-mould parts in cases where patterns placed in the mould chamber comprise parts protruding transversely to the direction of movement of the blowing-in tube, there being a great risk of the formation of "shadow regions" on the sides of the protruding parts not being directly hit by the mould sand being blown in.

In the disclosed process, it will also be appreciated that the compaction of the mould sand is achieved solely by means of the force with which it is thrown against the walls of the mould chamber, or sand having been blown in previously during the blowing-in operation. Especially when making moulds or mould parts to be used for casting objects with a complex shape, this can result in the mould or mould part not achieving the requisite compactness throughout its volume.

SUMMARY OF THE INVENTION

It is the object of the present invention to provide a method of the kind referred to initially, with which the disadvantage described can be remedied or removed, and this object is achieved by proceeding as set forth hereinbelow.

By, in the manner indicated, directing the blowing-in operation substantially transversely to the outward movement of the blowing-in member, a better filling of the regions around any protruding parts on the patterns is achieved, thus avoiding the formation of the "shadow regions" referred to.

By, in the manner indicated, forming two separate moulding-sand bodies which are subsequently pressed together to form a single coherent body, it is possible after the blowing-in step to compact the moulding sand with a force that is independent of the blowing-in force and which depends solely on the action of the squeeze plate or plates.

The present invention also relates to a mould-making machine for carrying out the method according to the invention.

Advantageous embodiments of the method and the mould-making machine and the effects thereof are explained in the following detailed portion of the present description.

BRIEF DESCRIPTION OF THE DRAWINGS

In the following detailed portion of the present description, the present invention will be explained in more detail with reference to the exemplary embodiments of a mould-making machine suitable for carrying out the method shown on the drawing, in which FIGS. 1–3 diagrammatically show a first exemplary embodiment of the mould-making machine during a process of blowing-in and subsequent pressing or squeezing, while FIGS. 4–6 in a corresponding manner show another exemplary embodiment of the mould-making machine during a process of the kind mentioned.

DESCRIPTION OF THE PREFERRED EMBODIMENTS

Figure 1:
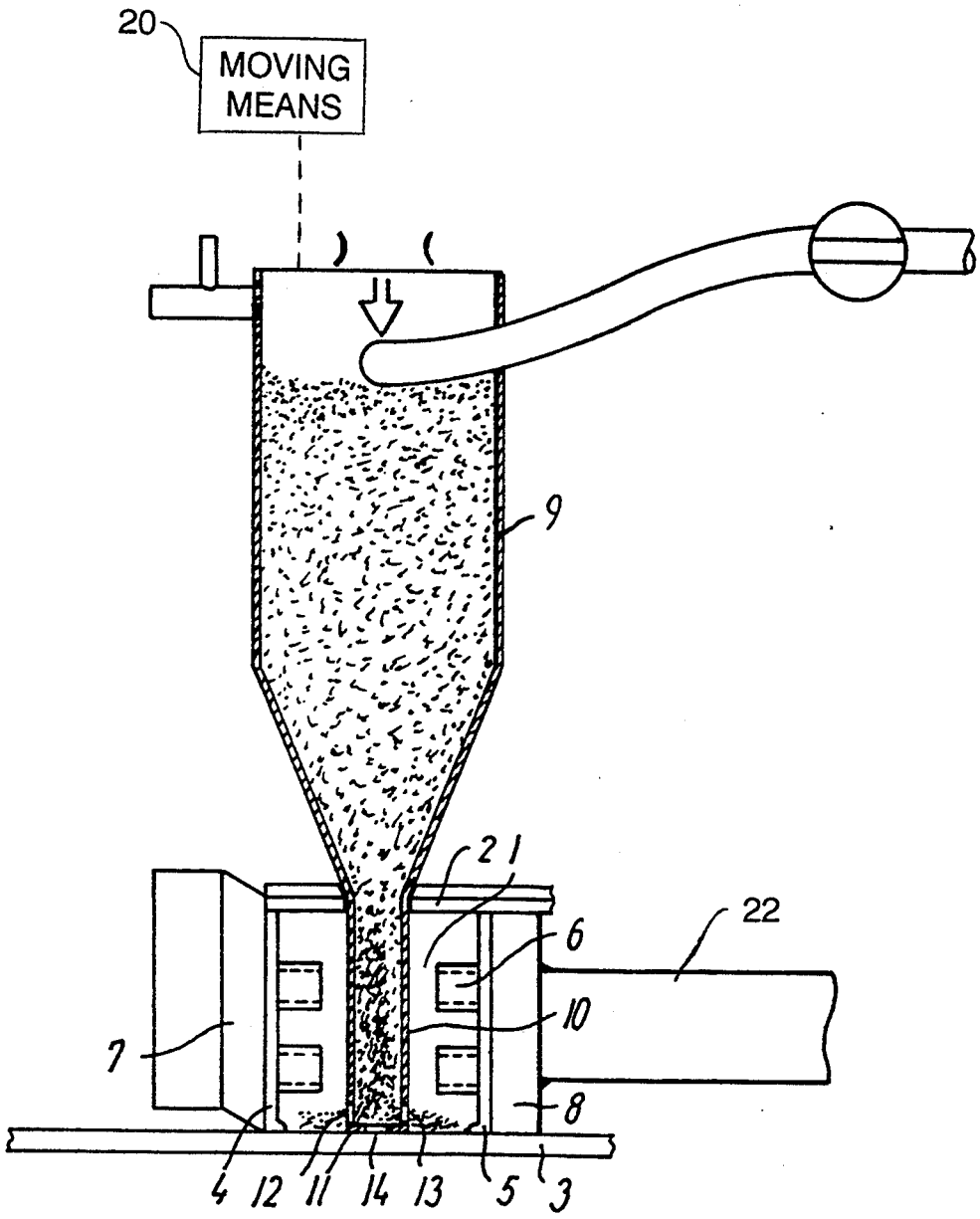

The mould-making press shown on the drawings, on which solely the parts necessary for explaining the invention are shown, comprises according to known principles a mould chamber 1 being formed between a top wall 2, a bottom wall 3 and four side walls, of which two extend parallel to and on both sides of the plane of the drawing, while the remaining two are constituted by a left-hand pattern plate 4 and a right-hand pattern plate 5. In the exemplary application shown, the pattern plates 4 and 5 carry a number of patterns 6 in the form of short pipe stumps or tubular bushes, the longitudinal axes of which extend parallel to the distance between the pattern plates 4 and 5 and which leave a central space therebetween.

The left-hand pattern plate 4 is secured to a squeeze abutment 7, whilst the right-hand pattern plate 5 is secured to a squeeze plate 8, in a known manner being moved towards the squeeze abutment 7 by a suitable moving means 22 for compacting the material having been introduced into the mould chamber 1 in a manner to be described below.

Further, the mould-making press comprises a sand reservoir 9, continuing downwardly in a blowing-in tube or duct member 10, through which sand from the sand reservoir 9 may be introduced into the mould chamber 1 by means of the difference in air pressure between the space above the sand in the sand reservoir 9 and in the mould chamber 1. This pressure difference may be produced by means of a super-atmospheric pressure in the space above the sand, or by means of a sub-atmospheric in the mould chamber 1, or both. In a manner not shown, the mould chamber 1 is provided with apertures, through which the air used for introducing the sand into the mould chamber can escape. The apertures may e.g. be provided in the pattern plates 4 and 5 and be distributed corresponding to the need for letting air escape in the various regions of the pattern plates.

At its lower end, the blowing-in tube 10 is closed by a bottom 11, and in the sides of the blowing-in tube laterally directed blowing-in slots 12 and 13 are formed, whilst a downwardly directed blowing-in slot 14 is formed in the bottom 11.

Figure 2:
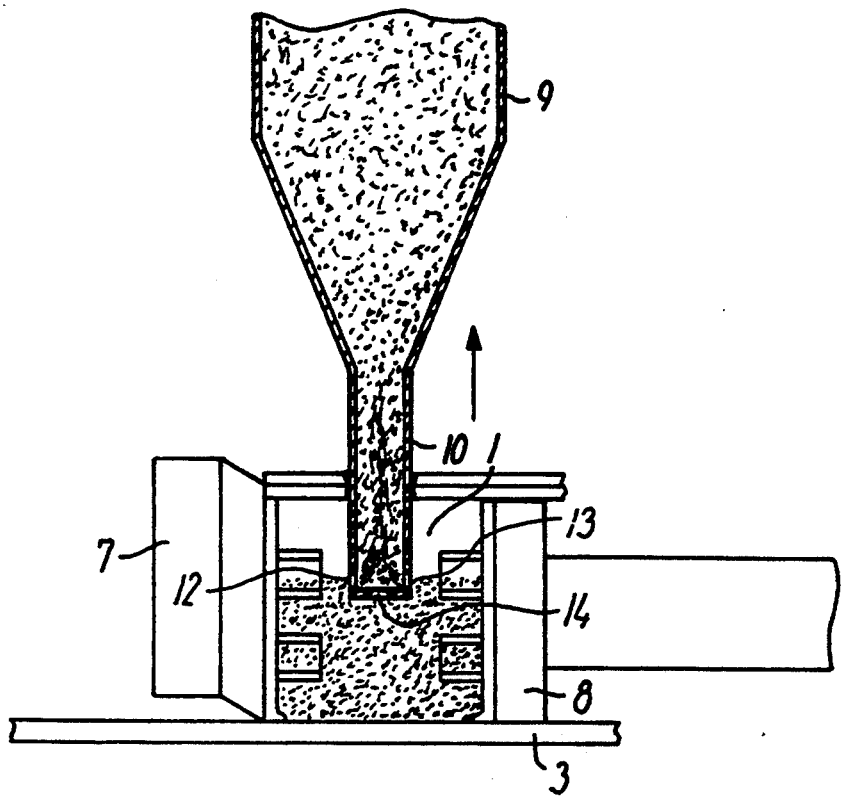

The whole assembly consisting of the sand reservoir 9 and the blowing-in tube 10 is adapted to be moved at high speed upwardly during the blowing-in of mould sand in the mould chamber 1 in a period measured in seconds or fractions of seconds by the action of moving means 20 schematically shown, such as compressed-air cylinders or the like. FIG. 2 shows the assembly 9,10 on its way upwardly at the same time as sand is being blowing into the mould chamber 1, both through the laterally directed blowing-in slots 12 and 13 and the downwardly directed blowing-in slot 14. As will be evident from FIG. 2, the mould sand being blown in through the laterally directed blowing-in slots 12 and 13 will be blown in in a direction generally parallel (or in a range, relative to the direction of movement, of between 60° and 120° and preferably 75° to 115 ° ) to the longitudinal axis of the patterns 6, so that the space within and around these patterns will be filled with mould sand without "shadow formation".

In the exemplary embodiment shown, in which the patterns are constituted by relatively thin-walled pipe stumps or tubular bushes, the assembly 9,10 may be moved upwardly with a more or less constant speed. But when using more voluminous patterns, with which the quantity of mould sand required varies markedly as a function of the height from the bottom wall 3, it may be advantageous to modulate the blowing-in operation in a controlled manner corresponding to the varying requirement. This may e.g. be achieved by program-controlling the means 20 moving the assembly 9,10 in a corresponding manner, e.g. so that the speed is held at a relatively high level in the locations, in which the requirement for mould sand is relatively small and relatively low in locations in which the requirement is relatively large.

Figure 3:
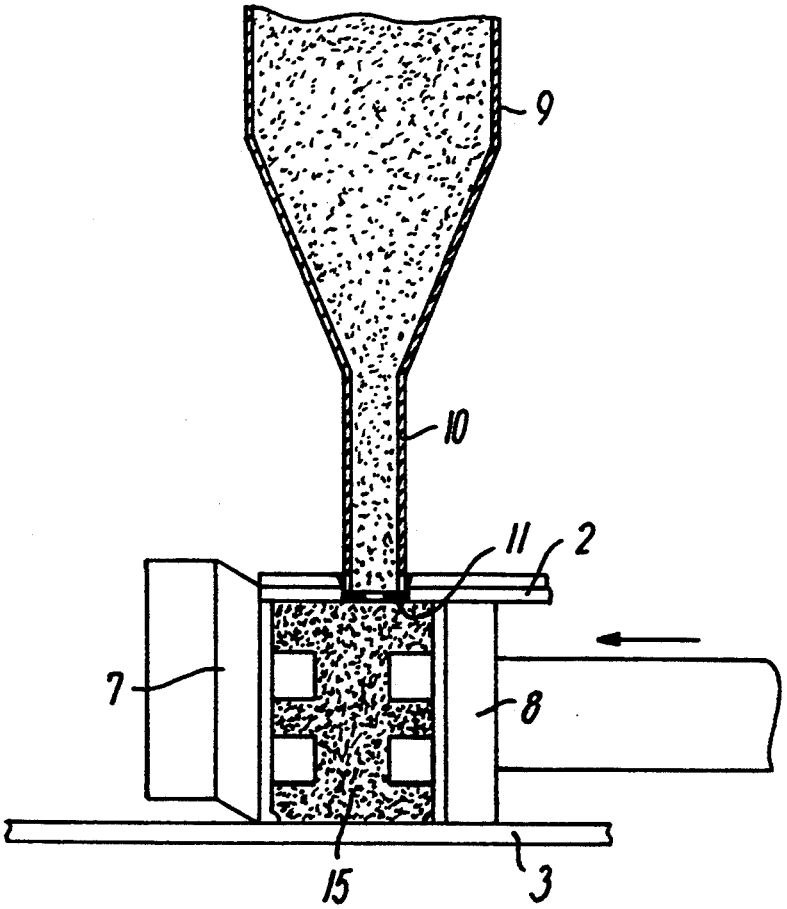

FIG. 3 shows the situation after the assembly consisting of the sand reservoir 9 and the blowing-in tube 10 has ceased to move, and the lower side of the bottom 11 in the blowing-in tube 10 is aligned with the lower side of the top wall 2. In the situation shown in FIG. 3, the squeeze plate 8 has already been moved through some distance toward the squeeze abutment 7, by which the mould sand in the mould chamber 1 has been compacted to form a double mould part 15 (i.e. a mould part of which the right-hand side is intended to cooperate with the left-hand side of an identically shaped mould part in a so-called string of moulds (not shown), whilst the left-hand side is intended to cooperate with the right-hand side of a further identically shaped mould part in such a mould string). At this point, it should be noted for the sake of good order that the drawing does not show how the requisite inlet ducts for the casting metal and the outlet ducts for the air being displaced are shaped, but persons with average skill in this field will know how to provide such ducts. Likewise for the sake of good order; it should be noted that the mould chamber 1 is adapted to be opened in a manner not shown to make it possible to remove the casting moulds or casting-mould parts having been produced, and the measures requisite for these operations are also known by persons of average skill in this field.

Figure 4:
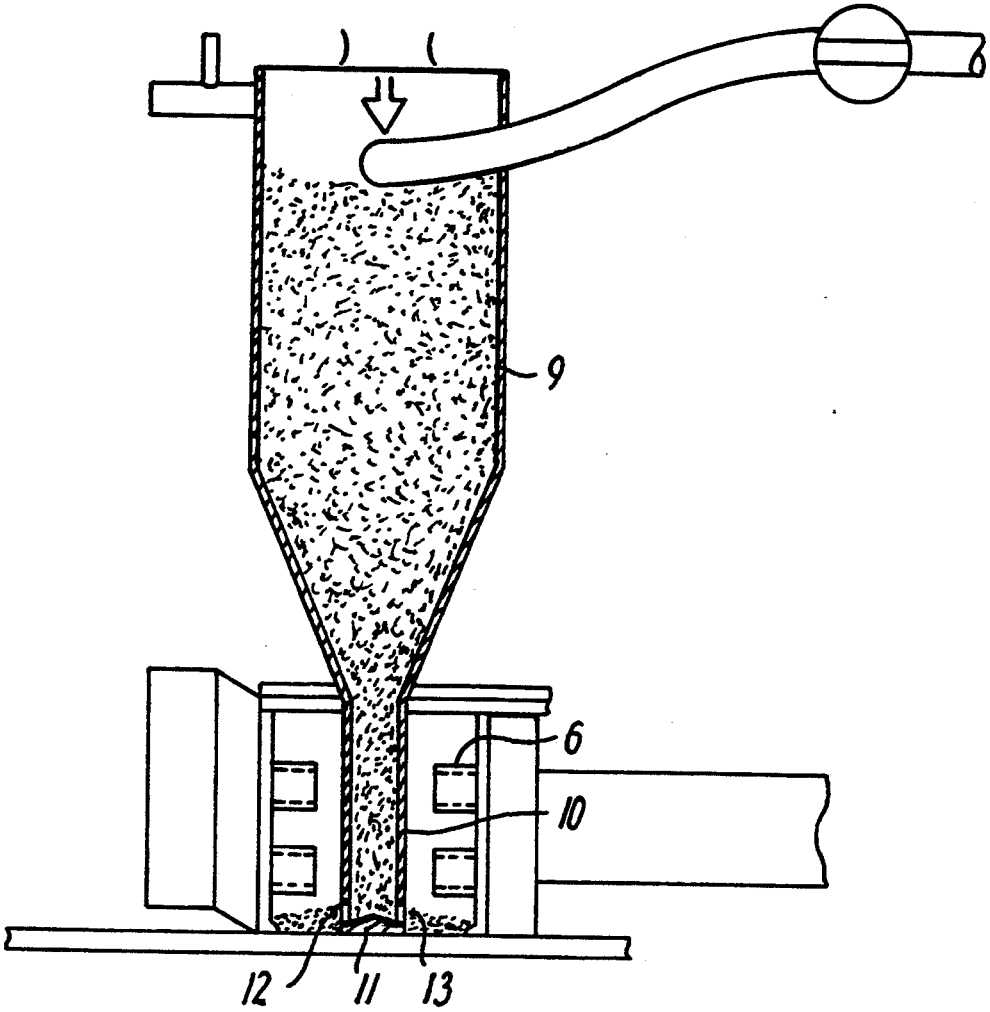
Figure 5:
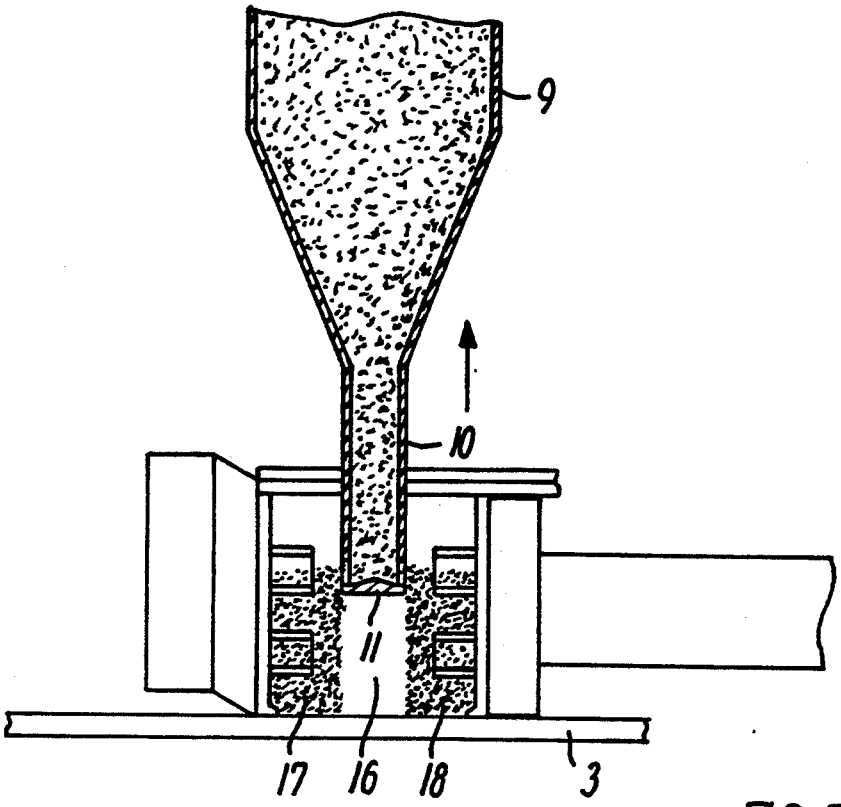
Figure 6:
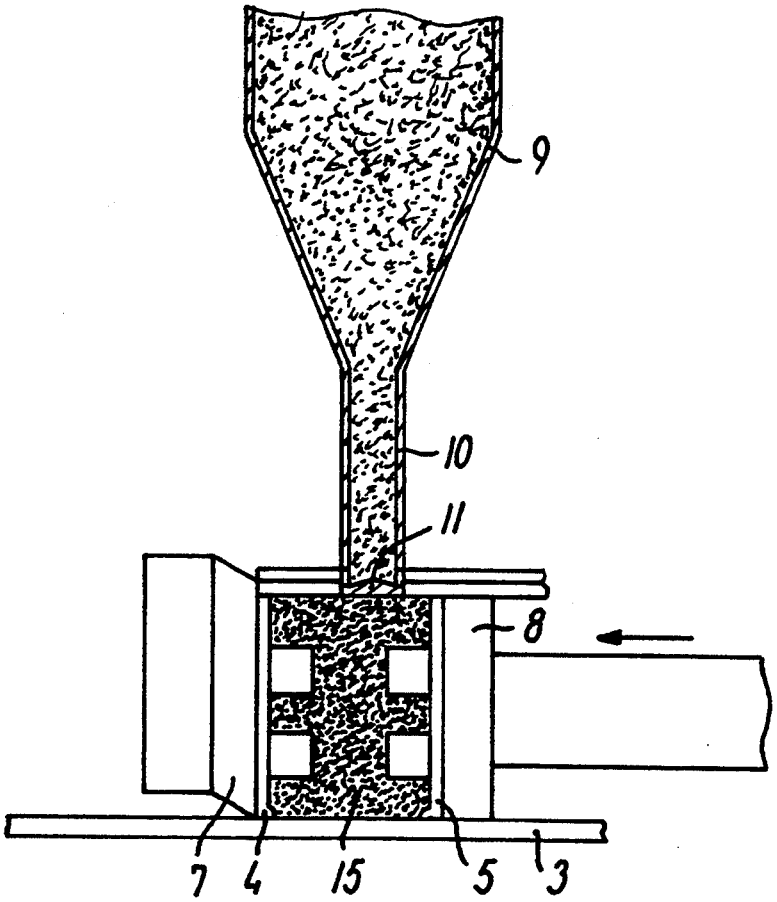

With one exception, all parts of the exemplary embodiment shown in FIGS. 4–6 are identical to the corresponding parts of the exemplary embodiments shown in FIGS. 1–3, for which reason they will only be referred to the extent required for understanding the effect of the exemplary embodiment shown in FIGS. 4–6.

The exception consists in that the bottom 11 in the blowing-in tube 10 is closed, i.e. it does not have the downwardly directed blowing-in slot 14 shown in FIGS. 1–3. As is especially evident from FIG. 5, the result is that the assembly 9,10 during its upward movement leaves a cavity 16 corresponding to the space being swept by the blowing-in tube 10 will necessarily extend at right angles to the plane of the drawing all the way between the two side walls in the mould chamber 1 lying parallel to and in front of and behind the plane of the drawing respectively, for which reason this blowing-in operation in fact results in the formation of two separate mould elements 17 and 18, one on each side of the cavity 16.

When the blowing-in operation is completed, cf. FIG. 6, the bottom 11 will, like in the situation shown in FIG. 3, be aligned with the top wall 2, so that it will not obstruct the inward movement of the squeeze plate 8 with the latter's pattern plate 5. In this manner, the two mould elements 17 and 18 are pressed together to form a double mould part 15, now ready to be removed and used for casting as described above.

In the exemplary embodiments described above, a mould-making press is used having one single squeeze plate 8 cooperating with a squeeze abutment 7, the latter being stationary at least during the operations of blowing-in and pressing or squeezing. It does, however, lie within the scope of the present invention, both to produce casting moulds or casting-mould parts in principle in the same manner as described with reference to FIGS. 1–3, and to use a mould-making press, in which during the pressing or squeezing operation two separate squeeze plates are moved towards each other.

I claim:

1. A method for producing casting moulds or casting-mould parts in a mould chamber with a blowing-in duct member, the mould chamber including (a) an opening through which the blowing-in duct member is introduced, (b) at least one pressing plate which is movable such that the mould chamber forms a press chamber, and (c) a central space in the mould chamber, the method comprising the steps of:

introducing the blowing-in duct member through the opening and a substantial distance into the central space of the mould chamber in a direction which is transverse to a direction of movement of the pressing plate;

providing the blowing-in duct member with (a) two blowing-in apertures respectively located, relative to the direction of introduction, on a side facing the pressing plate and on a side opposite therefrom, and (b) a width, as measured transversely to the direction of introduction and transversely to the direction of movement of the pressing plate, which substantially corresponds to an internal width of the central space;

blowing mould sand into the mould chamber through the apertures of the blowing-in duct member;

moving, as said blowing step is performed, the blowing-in duct member out of the central space and back through the opening along the direction of introduction, leaving an open cavity in the mould chamber devoid of moulding sand which corresponds to the width of the blowing-in duct member;

pressing the pressing plate inwardly along the direction of movement thereof to compress the mould sand in the mould chamber and eliminate the open cavity of the mould chamber such that respective mould elements formed by the mould sand blown in through the two blowing-in apertures are moved and pressed together so as to form a single casting mould or casting-mould part.

2. A method for producing casting moulds or casting-mould parts as claimed in claim 1 wherein the mould chamber includes first portions which require filling with relatively large volumes of mould sand and second portions which require filling with relatively small volumes of sand; and wherein said moving step includes the steps of moving the blowing-in duct member at varying speeds which speed is relatively low during passage past the first portions and relatively fast during passage past the second portions.

3. A method for producing casting moulds or casting-mould parts as claimed in claim 1 wherein the direction of introduction of the blowing-in duct member is vertically downward and the mould chamber includes a bottom wall; and wherein said introducing step includes introducing the blowing-in duct member to a position immediately adjacent the bottom wall of the mould chamber.

4. A mould-making machine for making casting moulds or casting-mould parts comprising:

a mould chamber including (a) a wall, (b) an opening in said wall, (c) at least one pressing plate which is movable such that said mould chamber forms a press chamber, and (d) a central space adjacent said opening;

a mould sand reservoir;

a blowing-in duct member which is introduced into said mould chamber through said opening so as to extend a substantial distance into said central space of said mould chamber in a direction which is transverse to a direction of movement of said pressing plate and which is subsequently withdrawn from said central space through said opening so as to not interfere with the movement of said pressing plate, said blowing-in duct member including (a) a first end fluidly connected to said mould sand reservoir, (b) a second end including two blowing-in apertures fluidly connected to said first end and respectively located, relative to the direction of introduction and after the substantial introduction into the central space, on a side facing said pressing plate and on a side opposite therefrom, and (c) a width, as measured transversely to the direction of introduction and transversely to the direction of movement of said pressing plate, which substantially corresponds to an internal width of said central space;

a first moving means for moving said blowing-in duct member the substantial distance into and then back out of said central space such that as mould sand is blown into said mould chamber from said mould sand reservoir through said apertures of said blowing-in duct member said blowing-in duct member is moved out of said central space and back through said opening along the direction of introduction leaving an open cavity in said mould chamber devoid of moulding sand which corresponds to said width of said blowing-in duct member; and a second moving means for moving said pressing plate such that subsequent to the withdrawal of the blowing-in duct member from said central space said pressing plate is pressed inwardly along the direction of movement thereof to compress the mould sand in said mould chamber and eliminate the open cavity of said mould chamber whereby respective mould elements formed by the mould sand blown in through said two blowing-in apertures are moved and pressed together to form a single casting mould or casting-mould part.

5. A mould-making machine as claimed in claim 4 wherein said first moving means moves said blowing-in duct member with a variable speed varying in a predetermined manner.

6. A mould-making machine as claimed in claim 5 wherein said second end of said blowing-in duct member has a bottom surface which faces inwardly and which is aligned with said wall in said opening after being moved out of said central space by said first moving means.

7. A mould-making machine as claimed in claim 4 wherein said second end of said blowing-in duct member has a bottom surface which faces inwardly; wherein said mould chamber includes a top wall in which said opening is provided and a bottom wall vertically opposite to said top wall; and wherein said first moving means moves said bottom surface of said blowing-in duct member to a position immediately adjacent said bottom wall.

* * * * *